United States Patent [19]

Brooks

[11] Patent Number: 4,695,072

[45] Date of Patent: Sep. 22, 1987

[54] ATHLETE CARRIER

[75] Inventor: Royce L. Brooks, Benicia, Calif.

[73] Assignee: Norman D. Koerner, Benicia, Calif.

[21] Appl. No.: 798,744

[22] Filed: Nov. 15, 1985

Related U.S. Application Data

[63] Continuation-in-part of Ser. No. 750,993, Jul. 2, 1985, which is a continuation of Ser. No. 349,913, Feb. 18, 1982, abandoned.

[51] Int. Cl.[4] ..... A47C 4/28

[52] U.S. Cl. ..... 280/650; 5/82 B; 280/47.25; 297/183; 297/423

[58] Field of Search ..... 280/242 WC, 289 WC, 280/647, 648, 650, 657, 47.25; 297/183, 423, 429, DIG. 4; 5/82 R, 82 B, 86, 89, 443; 128/75, 134; 269/328

[56] References Cited

U.S. PATENT DOCUMENTS

| | | | |
|---|---|---|---|
| 1,901,641 | 3/1933 | Goldblatt | 5/82 |
| 1,923,617 | 8/1933 | Edensword | 5/82 X |
| 2,609,864 | 9/1952 | Gates, Jr. | 297/429 |
| 3,061,365 | 10/1962 | Frieberg | 297/183 X |
| 3,072,437 | 1/1963 | Shea et al. | 297/423 X |
| 3,449,776 | 6/1969 | Brock | 5/82 |
| 3,887,228 | 6/1975 | Ingerson | 280/242 WC X |
| 4,534,075 | 8/1985 | Schnitzler | 5/89 X |

FOREIGN PATENT DOCUMENTS

| | | | |
|---|---|---|---|
| 60565 | 2/1943 | Denmark | 280/47.25 |
| 800006 | 6/1936 | France | 280/47.25 |
| 76395 | 6/1951 | Norway | 280/47.25 |

*Primary Examiner*—John J. Love
*Assistant Examiner*—Michael Mar
*Attorney, Agent, or Firm*—Schapp and Hatch

[57] ABSTRACT

Apparatus for manually transporting an injured person includes a chair having a seat, a backrest, front and rear legs, ground wheels on the rear legs and carrier arms which extend forwardly and backwardly at opposite sides of the chair. These elements are preferably foldable relative to each other from a chair configuration to a more compact storage configuration and the forward segments of the carrier arms are selectively detachable from the chair to facilitate seating of an injured person. A leg support cross strap extends between the forward carrier arm segments and additional straps enable each leg of the person to be secured to a separate one of the carrier arm segments. The device may be wheeled along the ground, where possible, by one or more carrier persons in front of the chair and may otherwise be lifted by carriers at the front and back of the chair. The device is particularly suited for transporting injured athletes from a playing field while also being useful in other situations that require manual transport of a person.

7 Claims, 6 Drawing Figures

ATHLETE CARRIER

This application is a continuation-in-part of my copending application, Ser. No. 750,993, filed July 2, 1985, and entitled "EVACUATION CHAIR"; which is a continuation of Ser. No. 349,913, filed Feb. 18, 1982, and entitled "EVACUATION CHAIR", now abandoned.

TECHNICAL FIELD

This invention relates to apparatus for manually transporting persons and more particularly to devices of that general type which may be used to carry injured athletes from a playing field or the like.

BACKGROUND OF THE INVENTION

Removal of injured athletes from playing fields presents specialized problems that are not met by the known carrying devices heretofore used for the purpose.

It has been the practice in the past to utilize a stretcher or a gurney or, in some extreme cases, to drive an ambulance vehicle onto the playing field. The injured player is then carried off the field in a prone position.

The use of such equipment tends to have a very traumatizing effect on the injured player, on spectators which may include an extensive television audience, and on the other players. It has been observed that such occurences can cause other players to become over cautious which can in turn lead to further injuries.

Players in general exhibit a strong aversion to being carried from the playing field in a prone position in such equipment. One unfortunate result has been that players may be insistant on walking from the field at times when that is very inadvisable from the medical standpoint. Many commom types of injury can be aggravated by walking or attempts to walk prior to medical diagnosis and treatment. In many sports, of which football and soccer are examples, leg injuries are a common occurence.

The form and severity of athletic injuries varies greatly. It is of course essential in some cases that equipment of the above described kind be used to remove an injured player not-withstanding the adverse effects on the player and on others that are described above. Owing to the lack of a suitable alternative, it has been the practice in the past to use such equipment in other cases where an injured player cannot or should not walk from the playing field.

The adverse effects of removing an injured athlete from the field in a prone position are greatly alleviated if the athlete is carried in a sitting position. Carrier apparatus for this purpose should enable seating and unloading of the athlete without requiring walking by the injured person and should minimize other physical effort by the injured person. Physical effort by the persons who operate the apparatus should also by minimized to the extent that is possible. The apparatus should be capable of inhibiting aggravation of an injury or suspected injury during the carrying operation. The carrier should also be light in weight and preferably compactible to facilitate the transporting and storage of the device.

A carrier device which meets some of the above described criteria and which is adaptable to carrying athletes with some kinds of injuries in a sitting position is described in my said copending U.S. patent application, Ser. No. 750,993, filed July 2, 1985, and entitled EVACUATION CHAIR, of which the present application is a continuation-in-part.

The carrier device of my above identified copending application includes a chair and spaced apart carrier arms that extend forward and backward from the sides of the chair, the structure being foldable into a more compact configuration when it is not in use. The device was originally designed for the purpose of carrying handicapped persons down the staircases of high rise buildings during a fire or other emergency and is not ideally suited for the differing purpose of removing injured athletes from a playing field. Seating of the handicapped person requires significant exertion and manuvering either by that person or on the part of the operators of the device. The seated person then assumes a normal sitting position, with bent knees and unsupported lower legs, that may not be compatible with many common forms of athletic injury.

The trauma associated with removing a player from a field in a prone position on a stretcher or the like can be greatly relieved with a transporting device which enables the player to travel in a sitting position and which also meets the specialized requirements of such operations which have been set forth above.

The present invention is directed to overcoming one or more of the problems discussed above.

SUMMARY OF THE INVENTION

In one aspect of the present invention, apparatus for manually transporting an injured person includes a chair having a seat, a backrest and front and rear legs and which has ground wheels mounted at the lower portions of the rear legs. First and second spaced apart carrier arms have front segments which extend forwardly from opposite sides of the chair. A removable cross strap extends between the front segments of the carrier arms at a location spaced forwardly from the seat and releasable means are provided for securing each leg of a person seated on the chair to a separate one of the front segments of the carrier arms.

In a more specific aspect of the invention, the apparatus further includes means for enabling selective withdrawal of either of the front segments of the carrier arms from the region in front of the seat.

In a still more specific aspect, the invention provides apparatus for manually transporting an injured person that includes a chair having a seat, a backrest and front and rear leg members which are foldable relative to each other from a chair configuration to a relatively compact storage configuration. First and second ground wheels are mounted on the rear leg members at opposite sides of the chair. First and second spaced apart parallel front carrier arm segments extend forwardly from opposite sides of the chair and first and second spaced apart parallel rear carrier arm segments extend backwardly from the opposite sides of the chair. The rear carrier arm segments extend a short distance from the chair than the front carrier arm segments. Means are provided for temporarily disconnecting either of the front carrier arm segments from the chair. A disconnectable cross strap extends between the front carrier arm segments at a location spaced forwardly from the chair and first and second pluralities of leg securing straps are attached to the first and second front carrier arm segments respectively. At least one of the leg securing straps on each front carrier arm segment is situated in front of the cross strap and at least one is situated between the cross strap and the chair.

The invention provides a safe, practical and easily operated mechanism for carrying athletes having many types of injury, including leg injuries, from a playing field in a comfortable upright sitting position. The apparatus does not necessarily require that the athlete walk or engage in other significant physical exertions in order to be seated. The apparatus provides support for the athlete's legs when that is advisable and further enables individual immobilization of either or both legs in cases where that may be necessary. Preferred forms of the carrier apparatus can be converted to a relatively compact configuration when not in use. The apparatus avoids the trauma associated with removal from a field in a prone position on a stretcher or the like and promotes player acceptance of being transported by other persons.

DETAILED DESCRIPTION OF THE PREFERRED EMBODIMENT

Figures 1, 2:
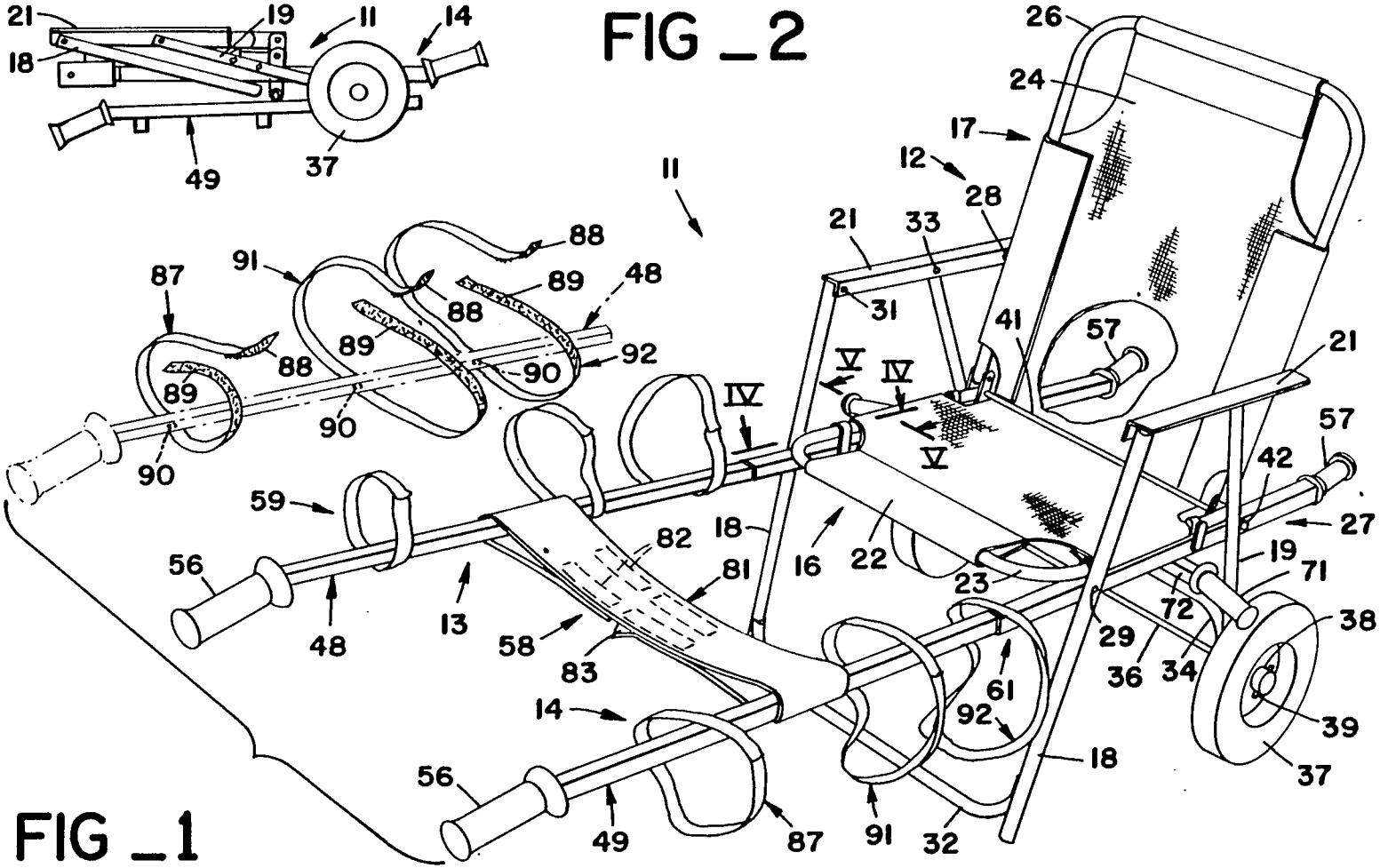
FIG. 1 is a perspective view of a preferred embodiment of the carrier apparatus for manually transporting a person.
FIG. 2 is a side elevation view of the carrier apparatus of FIG. 1 shown in an alternate relatively compact storage configuration.

Referring initially to FIG. 1 of the drawings, a carrier apparatus 11 for manually transporting injured persons in accordance with this embodiment of the invention includes a chair 12 and spaced apart parallel carrier arms 13 and 14 which extend forwardly and backwardly from the chair at opposite sides of the chair.

Chair 12 has a seat 16, backrest 17 and a front leg member 18, rear leg member 19 and arm rest 21 at each side of the chair. These components of the chair are preferably arranged to be foldable from the chair configuration shown in FIG. 1 to a more compact storage configuration as depicted in FIG. 2. For this purpose, with reference again to FIG. 1 in particular, seat 16 is formed by fabric 22 which is secured by stitching to a U-shaped tubular metal frame 23 that defines the front and sides of the seat and which is itself secured to carrier arms 13 and 14. Another portion 24 of the same fabric 22 is secured by stitching to another U-shaped tubular frame 26 which defines the top and sides of the backrest and which is coupled to the seat frame 23 through pivoting linkage 27 to be hereinafter described.

Arm rests 2 are attached to the sides of backrest frame 26 by pivot connections 28 and extend forward from the backrest in parallel relationship with the carrier arms 13, 14.

Front leg members 18 are attached to seat frame 23 through additional pivot connections 29 and extend both upwardly and downwardly from the seat 16, the upper ends of the front leg members being connected to the front ends of arm rests 21 by still additional pivot connections 31. A cross brace 32 interconnects the lower ends of front leg members 18 to strengthen the leg structure.

The rear leg members 19 also extend upwardly as well as downwardly from seat 16 and have upper ends coupled to the arm rests 21 by pivot connections 33. Another cross brace 34 interconnects the lower ends of the rear leg members 19 and an axle shaft 36 extends between and through the lower ends of the two rear leg members. A rotatable ground wheel 37 is journaled on each end of axle shaft 36 and held in place by a washer 38 and cotter key 39.

The rear leg members 19 are indirectly coupled to the seat frame 23 through the pivoting linkage 27 which will be hereinafter described.

A transverse rod 41 extends between and through the back ends of seat frame 23 and forms the bend between the seat portion 22 and backrest portion 24 of the fabric. End caps 42 are secured to each end of rod 41 to retain the rod and components of the pivoting linkage 27 in place.

Figure 3:
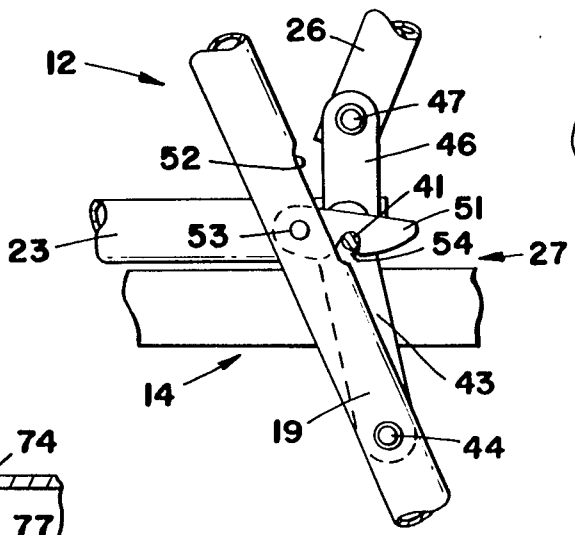
FIG. 3 is a side elevation view of a portion of the carrier apparatus of FIG. 1.

Pivoting linkage 27 may best be understood by reference to FIGS. 1 and 3 in conjunction. At each side of the chair 12 rod 41 extends through the upper end of a pivot link 43 which has a lower end coupled to the adjacent rear leg member 19 by a pivot connection 44. Rod 41 also extends through the lower ends of a pair of additional links 46 at each side of the chair which extend upwardly to opposite sides of the adjacent end of backrest frame 26 and which are coupled to the backrest frame by pivot connections 47.

The pivoting linkage 27 enables folding of the backrest 17 against seat 16 when the apparatus 11 is to be stored or transported to a playing field or the like where it may be needed. As the backrest 17 is interlinked with the arm rests 21 and front and rear leg members 18 and 19 as previously described, the folding motion brings the arm rests down towards carrier arms 13 and 14 and swings the lower portions of the leg members including ground wheels 37 up towards the carrier arms to the compact configuration shown in FIG. 2. The front segments 48 and 49 of carrier arms 13 and 14 respectively are disconnectable from the carrier apparatus 11, as will hereinafter be described in more detail, and may be detached to further reduce the bulk of the apparatus when it is in the storage configuration shown in FIG. 2.

Referring again to FIG. 3, a latch member 51 at each side of the chair 12 has a forward end entered into a slot 52 in rear leg member 19 and which is coupled to the rear leg member by another pivot connection 53. A notch 54 in the underside of the latch member 19 is located to engage on rod 41 when the chair 12 is unfolded to the operating configuration and thereby hold all of the pivotable components in fixed relationship to each other during use.

Referring again to FIG. 1, hand grips 56 at the front ends of carrier arms 13 and 14 are preferably angled downwardly and hand grips 57 at the back ends of the carrier arms are preferably angled upwardly relative to the other portions of the carrier arms. This provides for a more comfortable and less tiring orientation of the hands of the operators of the carrier apparatus 11 during use and particularly so if the apparatus must be fully lifted off the ground and be inclined in order to ascend or descend stairs, curbs or the like.

The apparatus 11 is made particularly suitable for the carrying of injured athletes by specialized characteristics of the carrier arm 13, 14 construction and by means 58 for supporting the injured persons legs and additional means 59 for individually immobilizing either or both legs of the injured person.

The carrier arms 13, 14 are proportioned to extend forwardly from chair 12 for a distance sufficient to support the legs of a seated person in an essentially parallel relationship with the carrier arms. The backward extension of the carrier arms 13, 14 from the chair 12 is substantially smaller than the forward extension. This avoids contact of the rear hand grips 57 with the ground or with minor irregularities in the underlying terrain when the forward ends of the carrier arms 13, 14 are raised in order to wheel the apparatus 11 along the ground.

Persons with certain types of injuries or physical handicaps, such as leg injuries for example, may not be able to walk between the carrier arms 13, 14 in order to seat themselves or that may at least not be advisable from the standpoint of avoiding aggravation of an injury. It may also be very taxing for other persons to lift such a person over the carrier arms 13, 14, during seating and unloading. Such problems are avoided by means 61 for enabling either of the front segments 48 and 49 of the carrier arms 13, 14 to be moved away from the region immediately in front of the chair 12 during seating or unloading of an injured person.

Such movement of the front segments 48 and 49 can be provided for by including latchable articulations in the carrier arms 13, 14 near the front of seat 16 but it is preferred to make such segments detachable from the other portions of the carrier arms. This avoids problems with manuvering the apparatus 11 in constricted spaces and also enables a greater reduction in bulk during storage or transport as previously described.

Figure 4:
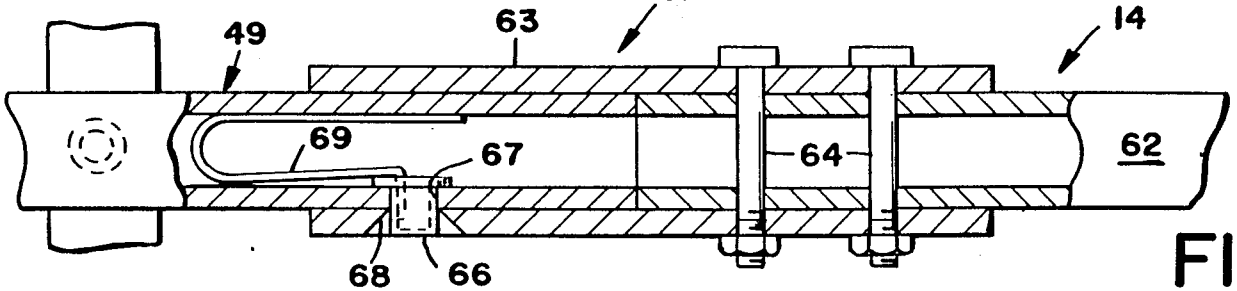
FIG. 4 is a broken out plan view of another portion of the carrier apparatus of FIG. 1 taken along line IV—IV thereof.

The means 61 for enabling selective withdrawal of either front segment 48, 49 are situated below the front corners of seat 16 and may be have a construction such as that shown in FIG. 4. In particular, the front end of the fixed portion 62 of carrier arm 14 extends into a sleeve 63 and the sleeve is secured to arm portion 62 by cross bolts 64. The carrier arms 14 are hollow and of rectangular cross section in this embodiment and the sleeve 63 has a similar configuration. In the assembled or operational condition of the apparatus the rear portion of front carrier arm segment 49 extends into the other end of sleeve 63 and abuts the fixed portion 62 of the carrier arm 14. Thus sleeve 63 rigidly holds front segment 49 and fixed portion 62 of the carrier arm 14 in colinear relationship.

Withdrawal of front segment 49 from sleeve 63 is prevented, except when it is intentionally brought about, by a hollow button 66 which extends through a bore 67 in the sidewall of front segment 49 and into a similarly located bore 68 in sleeve 63. A U-shaped leaf spring 69 within front arm segment 49 urges button 66 into bores 67 and 68 to latch the arm segment to sleeve 63.

Bore 68 is outwardly flared to enable insertion of an operator's finger when the button is to be depressed so that the front arm segment 49 may be withdrawn from sleeve 63 and separated from the other portions of the apparatus. Button 66 is preferably located at the inner side of sleeve 63, i.e. the side that faces the similar sleeve at the other side of the apparatus, as it then cannot be accidentally depressed by contact with objects which adjacent to the sides of the chair or beneath the chair.

Referring again to FIG. 1, it is advantageous to provide an outwardly extending supplemental hand grip 71 on the carrier arms 13, 14 at each side of chair 12. This enables a larger number of operators to assist in moving the carrier apparatus 11 and also facilitates manuvering of the apparatus. Sidewardly extending hand grips 7 can also cause problems in certain situations, such as in traveling through narrow doorways, as they increase the width of the apparatus 11. Such problems can be avoided if the supplemental hand grips 71 are easily detachable from the carrier apparatus 11.

Figure 5:
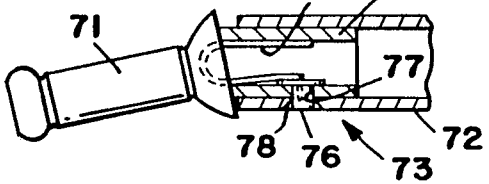
FIG. 5 is a view, partially in section, of still another portion of the carrier apparatus of FIG. 1 taken along line V—V thereof.

The supplemental hand grips 71 are, during use, attached to a hollow rectangular cross member 72 secured to the undersides of carrier arms 13, 14, below seat 16. Referring now to FIG. 5, a quick release attachment 73 for the hand grips 71 may be essentially similar to that previously described for connecting the front carrier arm segment 49 to the apparatus. Thus each hand grip 71 is secured to a hollow rectangular member 74 proportioned to fit with the end of cross member 72, the hand grip preferably being angled downwardly relative to members 74 and 72 to enable a more comfortably and secure grasping of the hand grip by an operator. A button 76 extends downward through a bore 77 in member 74 and into a flared bore 78 in the underside of member 72. A U-shaped leaf spring 79 within member 74 urges the button 76 into the bores 77 and 78. Thus the hand grip 71 is securely held on the end of cross member 72 but may be intentional withdrawn when necessary by depressing button 76.

Referring again to FIG. 1, the means 58 for supporting the legs of the seated person in this embodiment of the carrier apparatus is a removable sling or cross strap 81 formed of strong fabric. The cross strap 81 extends between the front segments 48, 49 of the carrier arms 13, 14 at a location spaced forwardly from seat 16 and has end portions which are doubled back around the carrier arms and attached to the underside of the central portion by disengageable attachment means 82, 83. The attachment means 82, 83 in this example includes fabric strips 82 having minute hooks and strips 83 having minute loops of the type that adhere when pressed together and which are marketed under the trademark VELCRO. Strips 82 are secured to the underside of the central portion of cross strap 81 and the mating strips 83 are secured to the opposite surface of the end portions of the cross strap. Engaged fabric strips 82, 83 of this kind are strongly resistant to shear forces such as are generated by the weight of a seated persons legs on cross strap 81 but are easily separated by pulling the strips directly outward from each other.

The leg sling or cross strap 81 can be fastened to one or both of the carrier arm front segments 48, 49 but is preferably a removable element to facilitate seating and unloading of an injured person and to enable adjustment of the longitudinal position of the cross strap along the arm segments to accomodate to persons of different size or to different locations of a leg injury. A removable cross strap 81 also facilitates carrying of a person in a more comfortable normal sitting position when leg support is not required.

Means 59 for securing an injured persons legs to separate ones of the front carrier arm segments 48, 49 enables immobilization of one or both legs when the nature of the injuries make that advisable. Such means 59, in this embodiment, includes a series of leg securing straps 87, 91, 92 attached to each front carrier arm segment 48, 49 at spaced apart locations along the arm segments.

Preferably at least one leg strap 87 is situated in front of cross strap 81 and at least one is located behind the cross strap. The present embodiment is provided with two leg straps 91 and 92 at spaced apart locations behind the cross strap 81 to provide still greater flexibility in accomodating to different sized individuals or different types of injury.

Each of the leg straps 87, 91 and 92 in this example is secured to the associated carrier are segment 48 or 49 by a screw 90 situated at the center of the leg strap. Fastener strips 88 and 89 of loop and hook type material respectively of the previously described kind are provided on the end portions of the leg straps 87, 91 and 92, the loop type material 88 being on one end portion and the hook type material 39 being on the opposite surface of the strap at the other end portion. Thus one or more of the straps 87, 91 and 92 may be wrapped around the injured person's leg and strips 88 and 89 may be be engaged to immobilize the leg.

In operation, the carrier apparatus 11 is used to transport players having injuries or suspected injuries that do not dictate immobilization of the whole body in a prone position but which prevent the player from walking or make that inadvisable. The apparatus 11 can quickly and easily be drawn onto the playing field when it is in the unfolded configuration shown in FIG. 1, by one or more persons who grasp and raise the front hand grips 56.

The initial step in seating of a player who cannot or should not stand and walk is temporary removal of one of the carrier arm front segments 48 or 49 in the manner hereinbefore described. In the case of leg injuries it is usually preferable to temporarily withdraw the particular carrier arm segment 48 or 49 that is on the same side as the location of the injury. For example, if the player's right leg is injured then the right front carrier arm segment 48 is temporarily withdrawn from the region in front of seat 16 as depicted in phantom in FIG. 1. The apparatus may then be easily manuvered to position the seat 16 immediately behind the player requiring movement or exertion on the part of the player.

Standing players may then seat themselves, alone or with assistance from others according to what may be medically advisable, without being required to walk or engage in other exertions. Sitting or prone players are assisted, by being lifted if necessary.

The withdrawn front carrier arm segment 48 or 49 is then returned and reengaged in its attachment mechanism. Some injuries may not require leg support or immobilization in which case the player may prefer to remain in a normal sitting position with bent knees and unrestrained lower legs. In other cases one or both of the player's legs are straightened, with assistance from others if necessary, and the leg sling or cross strap 81 is engaged on the carrier arm segments 48, 49 in the manner previously described to provide leg support. In most cases is preferable to position the leg sling 81 under the player's calves although some injuries may dictate a different placement.

If the injury requires immobilization of one or both of the player's legs, leg straps 87, 91 and 92 are then wrapped around one or both legs and engaged in the manner previously described.

Figure 6:
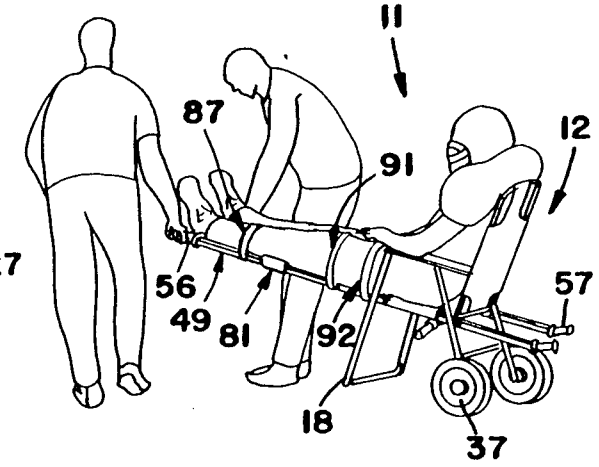
FIG. 6 is a perspective view illustrating a typical usage of the carrier apparatus of the preceding figures.

Referring now to FIG. 6, the player is then removed from the field by one or more persons who grasp and raise the front hand grips 56 and draw the apparatus in a forward direction if the movement is over a level surface such as a playing field.

The orientation of the apparatus 11 relative to the direction of travel may be reversed if it is necessary to descend a slope or stairs or the like, i.e. the player faces away from the direction of travel under that condition. The forward orientation, such as is used on a level surface, is employed when ascending a slope or stairs.

The rear carrier arm segments 27 enable lifting of the apparatus 11 including the seated player from the ground or other underlying surface by persons situated at both the front and back of the apparatus. The carrier apparatus 11 is lifted and in this manner if obstacles, such as curbs for example, are encountered. The apparatus 11 is also lifted and carried in this manner while ascending or descending stairs or while traveling over rough terrain.

The carrier apparatus 11 is particularly and uniquely suited for transporting injured athletes from a playing field and has been herein described in that context. It should be recognized that the apparatus 11 is equally useful in other situations where an individual who cannot or should not walk needs to be manually moved by other persons.

While the invention has been described with respect to a particular embodiment or example, many modifications are possible and it is not intended to limit the invention except as defined in the following claims.

I claim:

1. Apparatus for manually transporting an injured person comprising:

a chair having a seat, a backrest and front and rear leg members, said seat and backrest and front and rear leg members being foldable relative to each other from a chair configuration to a relatively compact storage configuration, first and second ground wheels mounted on said rear leg members at opposite sides of said chair, first and second attachment elements secured to opposite sides of said seat, first and second spaced apart parallel front carrier arm segments received within said attachment elements and extending forwardly therefrom and first and second spaced apart parallel rear carrier arm segments extending rearwardly therefrom, and wherein said rear carrier arm segments extend a shorter distance from said chair than said front carrier arm segments, means for releasably securing said front carrier arm segments and said rear carrier arm segments to said attachment elements, a handle secured to the end of each of said carrier arm segments, a disconnectable cross strap extending between said front carrier arm segments at a location spaced forwardly from said chair, and first and second pluralities of straps attached to said first and second front carrier arm segments respectively for securing at least one of the legs of an injured person to one of said front carrier arm segments with such leg in a extended position, at least one of said straps at each of said front carrier arm segments being situated between said chair and said cross strap and at least one of said straps at each of said front carrier arm segments being situated between said cross strap and said handle.

2. The apparatus of claim 1 further including comprising means for enabling selective withdrawal of either of said front segments of said carrier arms from the region in front of said seat so as to provide ready access to the front of said seat from either side.

3. The apparatus of claim 1 wherein each of said front segments of said carrier arms is selectively detachable from said chair.

4. The apparatus of claim 1 wherein said releasable securing means comprises latching means for preventing withdrawal of said rearward ends of said carrier arm segments from passages within said attachment elements except for deliberate withdrawal by an operator of said apparatus.

5. The apparatus of claim 1 wherein said first and second carrier arms have rear segments which extend rearwardly from said opposite sides of said chair and wherein said front segments extend a greater distance from said chair than said back segments.

6. The apparatus of claim 1 wherein each of straps have interlockable hook and loop fabric strips thereon which include a first strip of material on one side of the strap that has an array of hook elements and a second strip of material on the other side of the strap at a different location therealong, the second strip of material having an array of loop elements.

7. The apparatus of claim 1 wherein said ground wheels are provided on said rear legs only and said front legs are adapted to contact the ground or the like to frictionally resist rolling of said apparatus except when said front segments of said carrier arms are manually lifted.

* * * * *